US005643675A

United States Patent [19]

Ward et al.

[11] Patent Number: 5,643,675

[45] Date of Patent: Jul. 1, 1997

[54] ADDITION FOR PROMOTION OF BENCH LIFE EXTENSION IN A HOT BOX BINDER SYSTEM

[75] Inventors: William John Ward, Lisle; Robert Anton Laitar, Woodbridge; Bruce Eric Wise, Elmhurst, all of Ill.

[73] Assignee: Borden, Inc., Columbus, Ohio

[21] Appl. No.: 427,626

[22] Filed: Jun. 7, 1995

Related U.S. Application Data

[63] Continuation of Ser. No. 151,639, Nov. 13, 1993, abandoned.

[51] Int. Cl.[6] ..... B32B 27/02; C08G 8/28

[52] U.S. Cl. ..... 428/407; 525/480; 525/485; 525/488; 525/506; 525/534; 525/540; 164/526; 164/527; 164/528; 164/529; 428/402; 428/403; 428/404

[58] Field of Search ..... 525/480, 485, 525/488, 506, 534, 540; 164/526, 527, 528, 529; 428/402, 403, 404, 407

[56] References Cited

U.S. PATENT DOCUMENTS

| | | | |
|---|---|---|---|
| 3,104,230 | 9/1963 | Dewey et al. | 523/139 |
| 3,594,343 | 7/1971 | Huck et al. | 523/146 |
| 4,381,813 | 5/1983 | Kottke | 164/527 |
| 4,436,881 | 3/1984 | Laitar | 525/504 |
| 4,460,629 | 7/1984 | Haraga et al. | 427/221 |
| 4,468,486 | 8/1984 | Matsushima et al. | 523/146 |
| 4,514,316 | 4/1985 | Laitar | 252/182 |
| 4,540,724 | 9/1985 | Dunnavant et al. | 523/143 |
| 4,582,861 | 4/1986 | Galla et al. | 521/118 |
| 4,852,629 | 8/1989 | Fechter et al. | 164/16 |
| 4,884,620 | 12/1989 | Jhaveri et al. | 164/15 |
| 5,096,983 | 3/1992 | Gerber | 525/506 |
| 5,145,913 | 9/1992 | Gerber | 525/506 |
| 5,162,403 | 11/1992 | Fucik | 524/6 |
| 5,179,177 | 1/1993 | Gerber | 525/506 |
| 5,180,795 | 1/1993 | Gerber | 525/504 |

FOREIGN PATENT DOCUMENTS

| | | |
|---|---|---|
| 226136 | 10/1986 | Japan . |
| 433903 | 4/1979 | U.S.S.R. . |

*Primary Examiner*—Samuel A. Acquah

*Attorney, Agent, or Firm*—Roylance, Abrams, Berdo & Goodman, L.L.P.

[57] ABSTRACT

The invention relates to the use of tripotassium citrate monohydrate and other alkali metal salts of polybasic acid as bench life extenders in heat curable hot box foundry mixtures comprising sand, thermosetting binder resin, and a latent acid catalyst composition. In one embodiment, the thermosetting binder resin is a phenolic resole resin modified with urea formaldehyde resin. In another embodiment, the thermosetting binder resin is a furfuryl alcohol resin modified with urea formaldehyde resin.

30 Claims, No Drawings

ADDITION FOR PROMOTION OF BENCH LIFE EXTENSION IN A HOT BOX BINDER SYSTEM

This is a continuation of application Ser. No. 08/151,639 filed Nov. 13, 1995.

FIELD OF THE INVENTION

This invention relates to heat curable foundry mixes, heat curable resin binder compositions, and latent acid catalyst compositions particularly suitable for making foundry shapes by a hot box process. More particularly, the invention relates to bench life extended, heat curable, hot box foundry mixes.

BACKGROUND OF THE INVENTION

The hot box process is a high production method of producing cores and molds, used for casting metal pieces in foundry applications. The process involves the mixing of a latent acid catalyst, and a liquid thermosetting binder resin (e.g., a phenolic resole), with a quantity of foundry sand. The wetted sand mix is then blown into a heated pattern. The heat causes a curing mechanism to take place and a solid sand core or mold is obtained.

Typically, the catalyst/resin/sand mixture will become hard or gummy (non-flowable) when allowed to stand under ambient conditions for an extended period of time. The bench life of a sand mixture at ambient temperature can be defined as the time it takes for the mixture to become non-workable. Or put another way, the bench life can be defined as the maximum permissible time delay between mixing the binder components together with sand, and the production of acceptable products from the mixture. In most cases, a bench life of a few hours is sufficient. However, in some instances, a bench life greater than eight hours is required. For example, when the mixture is used to make molds and cores, a sand mixture may be required to remain unused in a storage hopper overnight. It is important that the sand mix not harden during this period because clean up would require additional effort, entail downtime, generate waste, and would mean a loss of efficiency. A means of extending the bench life of a hot box sand mixture to at least 24 hours would minimize these negative effects.

Current state of the art bench life additives, such as ammonia, have limited use as extender materials. Furthermore, ammonia has an associated odor problem. The use of effective carbonate materials such as calcium carbonate as bench life additives has the disadvantage of insolubility in either or both of the catalyst and the resin. Thus, an extra addition system is required when using these materials. Furthermore, carbonate materials can have a negative effect on the tensile strengths of the cores produced.

We have now found that the use of an alkali metal salt of a polybasic acid as an additive to a hot box sand mixture can extend the bench life of the coated sand mixture. A bench life extender of this type may allow a production batch of the resin coated sand to remain unused in a hopper for extended periods and still remain workable.

According to one embodiment of the invention, a bench life extension additive, such as tripotassium citrate or dipotassium phosphate, can be added to the sand as a solid before the resin and catalyst are added, at a level of 0.01 to 0.1% based on sand weight, in which case three components are added to the sand. The bench life extension additive, the resin and the catalyst can be added to the sand in any order. Alternately, the additive can be formulated into the resin or catalyst, in which case only two components (the catalyst component and the resin component) need be added to the sand.

The bench life extension materials of the invention have the advantage of being soluble in the catalyst, and they are low in odor. Thus, the use of these materials would not increase production steps, and they are generally compatible with the components and equipment used to produce hot box foundry cores and molds, while maintaining the desirable properties of the cured cores and molds.

SUMMARY OF THE INVENTION

Accordingly, the present invention relates to the use of alkali metal salts of polybasic acids as bench life extenders in the matter of the ambient temperature hardening of heat curable foundry mixtures composed of sand, a thermosetting binder resin (hot box resin), and a latent acid catalyst (hot box catalyst).

The invention also relates to compositions comprising the inventive bench life extender. One embodiment is a composition which is a mixture of a hot box catalyst and a bench life extender of the invention. Another embodiment is a composition which comprises hot box resin and the bench life extender. Also, in another embodiment, the inventive composition may comprise sand, resin and the bench life extender.

The invention may also relate to a method of retarding the ambient temperature hardening of a hot box foundry mixture. In one embodiment, the method comprises premixing of the bench life extender with the hot box catalyst or alternately the premixing of resin and the bench life extender. In another embodiment of the invention the method comprises mixing the bench life extender with sand, resin and catalyst.

DETAILED DESCRIPTION OF THE INVENTION

The invention relates to the discovery that alkali metal salts of polybasic acids are useful as bench life extenders to retard the ambient temperature hardening of heat curable hot box foundry mixtures, these mixtures comprising a latent acid catalyst and thermosetting binder resin, mixed with foundry aggregate such as sand.

Definitions

Selected terms used in the specification are defined below, for clarity.

The term "alkali metal" is used to refer to the metals sodium, potassium, and lithium. The term is also intended to include mixtures of these materials.

The term "mineral acid" is used to refer to acids conventionally considered mineral acids, and in the context of the present invention, they must be polybasic. One such acid is phosphoric acid.

The term "polybasic" is used as a descriptive term with respect to acids that have the property of being able to combine with two or more alkali metal atoms per molecule of the acid, or per molecule of the salt that is formed.

An "alkali metal salt of a polybasic acid" is used to refer to a salt in which the acid is polybasic and the acidic moieties in the acid are generally combined with at least one alkali metal atom.

The Hot Box Process

In typical foundry practice, a resin sand mix is formed into a shape, and the resin is cured to bind the sand into the desired shape. The hot box process uses a hot box binder. Such binders typically are inexpensive but produce satisfactory results.

In the prior art, it is the hot-box process which is particularly suitable for the mass production of automotive castings, such as cylinder heads or engine blocks.

To form a core for a casting, a heated pattern cavity is filled with resin sand mix. In the hot box process, the catalyst is often included in the resin sand mix. When the resin sand mix is placed in the pattern, and high temperatures are applied, rapid curing of the resin occurs, to make a core that is capable of being handled for removal from the pattern. Such a core generally has high strength so as to withstand handling, and is stable during storage, over a long period of time. Ideally, the resin binder is one that will permit the resin sand mix to be characterized by high flowability, for ease in filling the pattern with the resin sand mix.

Even though known prior art binder systems, using known prior art catalysts, commonly exhibit bench lives of from one up to four hours, it is preferable that such binders have bench lives equal to at least the length of one shift, that is, about eight hours, and more preferably, bench lives of at least twelve or even twenty-four hours.

Thermosetting Binder Resin

The resin employed is used in an effective binding amount. Such an amount is one that will impart adequate tensile strength to the foundry shape, when used with the bench life extender and other materials identified below, for the production of a foundry shape. Generally an effective binding amount of the resin is from 0.5 weight percent to about 8 weight percent, based on the weight of the sand, and usually, from about 1.0 weight percent to about 3.0 weight percent of binder based on sand. In this paragraph and hereafter, when referring to binder amounts, the reference is to the weight of liquid resin binder, as is basis.

It is contemplated that a broad range of phenolic resole resins may be used in this invention as well as phenolic resoles modified with urea resins, furfuryl alcohol resins, and furfuryl alcohol modified with urea resins. These phenolic resins can be phenol formaldehyde resole resins, or those wherein phenol is partially or completely substituted by one or more phenolic compounds such as cresol, resorcinol, 3,5-xylenol, hisphenol-A, or other substituted phenols. The aldehyde portion can be partially or wholly replaced by acetaldehyde or furfuraldehyde or benzaldehyde. The preferred phenolic resole resin is a condensation product of phenol and formaldehyde.

Although it is possible to use liquid phenolic resole resin by itself as the hot box binder, the cure rate of the liquid phenolic resole resin by itself may be unacceptable for mass production casting operations when it is desirable to use short cycle times. For that reason, most commercial hot box resins are of two general categories. One such category is composed of phenolic resoles blended with urea formaldehyde (PF/UF), and the second is furfuryl alcohol resins blended with urea formaldehyde resins (FA/UF). The commercial PF hot-box resins available on the market today usually contain 5% to 10% by weight nitrogen (percentage of nitrogen being a measure of the amount of urea in a binder).

The phenolic resole resins used in the hot box process, and in the practice of the present invention, are generally made from phenol and formaldehyde at a mole ratio of formaldehyde to phenol in the range from about 1.1:1.0 to about 3.0:1.0. A preferred mole ratio of formaldehyde to phenol is one in the range from about 1.7:1.0 to about 2.7:1.0.

Resole resins are thermosetting, i.e., they form an infusible three-dimensional polymer upon the application of heat. They are produced by the reaction of a phenol and a molar excess of a phenol-reactive aldehyde, generally formaldehyde, typically in the presence of an alkali or alkaline earth metal compound as a condensation catalyst. The phenolic resole resin is generally formed in an aqueous basic solution. The base is usually an alkali metal hydroxide or an alkaline earth metal hydroxide, such as, for example, potassium hydroxide, sodium hydroxide, calcium hydroxide, or barium hydroxide, but preferably sodium hydroxide. Such aqueous phenolic resole solutions are available commercially. The proportions of the reactants and the reaction conditions described here are guidelines for those who wish to prepare their own aqueous resole solutions for use in the hot box process.

Typically, the resole resin will be blended with an urea formaldehyde (UF) resin to give a hot box resin useful to this invention. The UF resin is added to improve the tensile strengths and speed of cure in the foundry cores and molds. The UF resins are generally made from urea and formaldehyde at a mole ratio of formaldehyde to urea in the range from 2.0:1.0 to about 3.0:1.0. The ratio of resole to UF resins can vary widely but is normally set to give a PF/UF resin containing 5–10% nitrogen, the nitrogen being introduced by the urea in the UF resin. An example of a PF/UF resin is the Acme 745PL hot box resin having a phenol: formaldehyde: urea molar ratio of 1:4.1:0.8, respectively. These ratios can vary widely depending on the intended application.

The pH of the phenolic resole resin used in this invention will generally be in the range of about 4.5 to about 9.5, with a pH of 5 to 8.5 being preferred. Free phenol will typically be about 2% to about 25% by weight of the resin with preferred levels being about 5% to about 12%. Free formaldehyde levels can range from 1% to 20%, with the preferred range of 2–8%. Acme 745PL hot box resin contains a typical 3.7–4.1% free formaldehyde.

The viscosity of the phenolic hot box resin solution can be in the broad range of about 100 cps to about 4,000 cps at 25° C. Preferably, the viscosity varies from about 200 cps to 3,000 cps at 25° C., and particularly from about 250 cps to 1,000 cps at 25° C. Acme 745PL hot box resin has a typical viscosity of 500 cps, with a refractive index value of 1.519. The viscosity measurements herein are reported in centipoises (cps) as measured by a Brookfield RVF viscometer at 25° C. at 20 rpm, using a No. 2 spindle, or by Gardner-Holt viscosities, at 25° C. The Gardner-Holt viscosities, which are in centistokes, are multiplied by the specific gravity (generally 1.2) to give the cps at 25° C.

The solvent portion of the liquid resin is generally water. Non-reactive solvents in addition to water can be selected from alcohols of one to five carbon atoms, diacetone alcohol, glycols of 2 to 6 carbon atoms, monomethyl and dimethyl or butyl ethers of glycols, low molecular weight (200–600) polyethylene glycols and methyl ethers thereof, phenolics of 6 to 15 carbons, phenoxyethanol, aprotic solvents, e.g., N,N-dimethylformamide, N,N-dimethylacetamide, 2-pyrrolidinone, N-methyl-2-pyrrolidone, dimethyl sulfoxide, tetramethylene sulfone, hexamethylphosphoramide, tetramethyl urea, methyl ethyl ketone, methyl isobutyl ketone, cyclic ethers such as tetrahydrofuran and m-dioxolane, and the like. Furfuryl alcohol may be included as a reactive solvent.

Typical water content for the resole resins used in this invention will be in the range of about 5% to about 20% by weight of the resin solution.

In order to improve the flow of the mixture and to facilitate the removal of the cores from the mold, lubricants and release agents like linseed oil or stearates can be added.

Bench Life Extender-Alkali Metal Salts of Polybasic Acids

The preferred bench life extenders of the invention include the alkali metal salts of citric acid, succinic acid, phthalic acid and phosphoric acid.

Particularly suitable are tripotassium citrate monohydrate; dipotassium phosphate; monosodium citrate; disodium citrate sesquihydrate; trisodium citrate dihydrate; disodium succinate; dipotassium phthalate, and mixtures thereof. It is contemplated that other alkali metal salts of citric acid, succinic acid and phthalic acid, and alkali metal salts of other polybasic acids, would make suitable bench life extenders.

The general category of bench life extender salts, that are considered to be useful in the practice of the present invention, are the alkali metal salts of polybasic acids. Those that are particularly preferred are tripotassium citrate monohydrate, and dipotassium phosphate.

The bench life extender salt is selected as one that is soluble in either the catalyst composition, the resin solution, or both. Solubility in both is very convenient, making it possible to add the bench life extenders either directly to the sand, prior to adding the resin and catalyst composition, or to the resin solution, or to the catalyst composition.

Generally the preferred bench life extenders are those selected from the group consisting of tripotassium citrate monohydrate; dipotassium phosphate; monosodium citrate; disodium citrate sesquihydrate; trisodium citrate dihydrate; disodium succinate, dipotassium phthalate, and mixtures thereof. These are effective in different amounts in different binder-catalyst formulations. Generally, as shown in the examples, amounts in the range from about 0.01% to about 0.08% by weight based on sand are found to lead to good results.

Latent Acid Catalyst

One suitable latent acid catalyst (i.e. hot box catalyst) is one that was obtained from Acme/Borden, Forest Park, Ill. and identified as Acme 43MR2B. Other hot box catalysts available in the market can also be used. Hot box catalysts generally comprise ammonium salts such as ammonium chloride and ammonium nitrate. The optimum ammonium salt level to be added depends on the sand, the hot box resin used, and the cure requirements of the specific application. The amount of latent acid catalyst used with the hot box resin is typically in the range from about 2 weight percent to 25 weight percent based on the weight of the hot box resin.

The catalyst can be used as a vehicle by means of which to add other desirable additives that exhibit beneficial effects. For example, urea can be added to an aqueous catalyst composition, for the purpose of acting as a scavenger for formaldehyde, with the formation in situ of a urea formaldehyde resin. Typically, the aqueous catalyst composition comprises an amount of urea in the range of from about 30 weight percent to 45 weight percent based on the weight of the aqueous catalyst composition.

Similarly, a silicone emulsion may be incorporated in the catalyst composition, as a release agent, or a silane for imparting increased strength to the cured core or mold. These additives are generally incorporated at levels below 5% of the catalyst weight. In addition, the bench life additive salt may be incorporated in the catalyst composition.

In Example 5 below, such a catalyst composition is described in terms of the proportions of the several ingredients of the composition. Those proportions are representative only and not only may the proportions be changed if desired, but in addition, some of the individual ingredients of the catalyst composition may be omitted entirely if desired.

Granular Refractory Material

The granular refractory materials used in the present invention may be any of the refractory materials employed in the foundry industry for the production of molds and cores, such as silica sand, chromite sand, zircon sand, or olivine sand.

Auxiliary Components and Their Purposes

The use of a silicone compound is indicated, as an ingredient in the catalyst composition or the resin, where the cured foundry shape must show a high degree of resistance to water. The addition of a silicone compound generally is observed to improve the resistance of the foundry shape to moisture.

Representative silicone compounds, that can be used to improve release, may be polydimethylsiloxanes, often and preferably trimethylsilyl terminated. These materials are sold commercially as fluids and as emulsions. The emulsions contain water and a surfactant as well as the silicone compound. Representative examples of commercially available silicone products, that are effective, include DC 1101, DC 108, DC 24 and DC 531. The first three of these are emulsions, sold by Dow Corning Corporation. Other commercially available silicone compounds, sold by Union Carbide and General Electric respectively, are LE-460, and AF-70.

While the silicone compound may be added to the catalyst composition, it can also be mixed with the foundry aggregate after the resin binder, bench life extender, and catalyst composition are added to the aggregate. The amount of silicone compound in emulsion form that is used in a given sand mix (i.e., sand combined with the resin binder by mixing sand and resin binder, and including or separately mixing in the catalyst composition and bench life extender salt) is in the range from 0.01 weight percent to 1.0 weight percent, based on the weight of the sand, and generally, from 0.05 weight percent to 0.1 weight percent.

Silanes can also be added if desired, but are often present in commercial phenolic resole resins, since they are known to improve bonding of the resin to the foundry aggregate and thus to improve tensile strengths.

Other components that may be used include release agents and solvents, and these may be added to the resin binder, the catalyst composition, the aggregate, or the sand mix.

EXAMPLES

The examples which follow will illustrate specific embodiments of the invention. They are not intended to imply that the invention is limited to these embodiments. In the examples and throughout the parts are by weight unless otherwise specified. In some places, the term "based on sand" has been abbreviated to read "B.O.S.".

In Examples 1–5, the thermosetting resin used was a commercially available phenolic/UF hot box resin obtained from Acme Resin Corp., Forest Park, Ill. and identified as Acme 745PL. Example 6 demonstrates the invention where the hot box resin is a furfuryl alcohol/UF resin blend.

Unless otherwise indicated, the catalyst used in the examples was a commercially available hot box catalyst also obtained from Acme Resin Corp., Forest Park, Ill. and identified as Acme 43MR2B. The sand used was Wedron 530 silica sand obtained from the Wedron Silica Co., 177 Walnut and Jackson Streets, Wedron, Ill. 60557.

In the examples mixing was done using a K45 Kitchen Aid mixer available from Kitchen Aid Inc., St. Joseph, Mich. The cores of the examples were 1 inch dog bones that were made using a Redford HBT-1 core blower sold through DIETERT, a division of George Fischer Foundry Systems Inc. of Holly, Mich. The sand mixes were blown at 90 psi air pressure into a 425° F. (218° C.) block and held for suitable curing times before ejection of the dog bones.

In one test, dog bones made from freshly made sand mixes were ejected from the core blower, and cooled. Their tensile strengths were then measured using a Detroit Testing Machine Company Model CST Tensile Tester obtained from the Detroit Testing Machine Company of Detroit, Mich.

In another test, where the dog bones were again made from freshly made sand mix, shortly after ejection of the dog bones and while the dog bones were still hot, the dog bones were broken to test their strengths using a DIETERT Machine Model 400-1 Universal Sand Strength Tester obtained from DIETERT, a division of George Fischer Foundry Systems, Inc. of Holly, Mich.

In a third test, dog bones made from mixes that had been stored in a closed container for 24 hours, were ejected from the core blower after 30 seconds and cooled. The dog bones were tested for tensile strength using the Detroit Testing Machine Company Model CST Tensile Tester.

In a fourth test, dog bones made from mixes that had been stored in a closed container for 24 hours were ejected from the core blower after 30 seconds and while the dog bones were still hot, the dog bones were broken to test their strength using the DIETERT Machine Model 400-1 Sand Strength Tester.

MAKING OF A SAND MIX COMPRISING PHENOLIC/UF HOT BOX RESIN, CATALYST, ADDITIVE (BENCH LIFE EXTENDER) AND SAND, BLOWING OF SAND MIX INTO 425° F. (218° C.) BLOCK TO MAKE DOG BONES, AND MEASURING OF TENSILE STRENGTH OF COOLED DOG BONES

EXAMPLE 1

Additive, Catalyst and Resin Each are Added to Sand in Separate Steps

In this example, seven different additives of the invention (i.e., bench life extenders) were tested in phenolic hot box resin and sand mixes. The seven additives tested were tripotassium citrate monohydrate; dipotassium phosphate; monosodium citrate; disodium citrate sesquihydrate; trisodium citrate dihydrate; disodium succinate, and dipotassium phthalate. In each case, the amount of additive used was 0.04% by weight based on the weight of sand (B.O.S.). The procedure used was as follows:

3000 grams of sand and 1.2 grams of additive were placed in a mixer and mixed for 1 minute. 10.2 grams of hot box catalyst were added and mixed for two minutes. 51.5 grams of phenolic/UF hot box resin were added and mixed for three minutes to thereby coat the sand to make the hot box resin and sand mix.

In one set of tests, the sand mix was immediately blown at a pressure of 90 pounds per square inch into a 425° F. (218° C.) dog-bone block. The dog bones were ejected, cured from the block after 10 seconds. Tests were repeated so that dog bones were ejected after 10 seconds, 30 seconds and 40 seconds. The tensile strength of each of the dog bones was measured after the dog bones had cooled. Dog bones were similarly made from a control sand mix without any additive.

In another set of tests, the freshly-made sand mix was placed in a closed container for 24 hours. Then the sand mix, which had been at ambient temperature for 24 hours, was blown into the 425° F. (218° C.) dog bone block and the dog bones were ejected, cured, after 30 seconds. The tensile strengths were measured after the dog bones had cooled. It was not possible to make dog bones from a 24-hour old control sand mix without an additive, because after 24 hours the control sand mix was hard and unblowable.

The results of these tests are reported in Table 1. The results of the tests show that after standing at room temperature for 24 hours, the control sand mix was hard and unblowable, whereas each of the sand mixes that included one of the seven additives of the invention was blowable and was either fluffy, or fluffy/spongy, or spongy, and that dog bones made with these mixes had reasonable tensile strengths.

These results demonstrate that the bench life extender additives of the present invention greatly reduce the tendency of the foundry mixes, containing a phenolic hot box resin and hot box catalyst, to become hard and unusable after being held in a closed container for 24 hours at ambient temperature.

TABLE I

TENSILE STRENGTH TESTING OF DOG BONES
Dog Bones Made From Mix of 3000 Parts Sand, 10.2 Parts Catalyst, 51.5 Parts Resin and 1.2 Parts Additive, and Control Dogbones Made From Mix of 3000 Parts Sand, 10.2 Parts Catalyst and 51.5 Parts Resin

| Time, in seconds that cores are held in mold at 425° F. (218° C.) after a blowing at a pressure of 90 psi. | Tensile Strengths (psi) | | | | | |
|---|---|---|---|---|---|---|
| | 10* | 20* | 30* | 40* | 30 hot** | 30 after 24 hrs.*** |
| Additive | | | | | | |
| None | 372 | 586 | 593 | 579 | 73 | — (a) |
| Tripotassium citrate, monohydrate | 133 | 257 | 374 | 502 | 38 | 299(b) |

TABLE I-continued

TENSILE STRENGTH TESTING OF DOG BONES
Dog Bones Made From Mix of 3000 Parts Sand, 10.2 Parts Catalyst, 51.5 Parts Resin and 1.2 Parts Additive, and Control Dogbones Made From Mix of 3000 Parts Sand, 10.2 Parts Catalyst and 51.5 Parts Resin

| Time, in seconds that cores are held in mold at 425° F. (218° C.) after a blowing at a pressure of 90 psi. | Tensile Strengths (psi) | | | | | |
|---|---|---|---|---|---|---|
| | 10* | 20* | 30* | 40* | 30 hot** | 30 after 24 hrs.*** |
| Dipotassium phosphate | 138 | 316 | 503 | 517 | 0 | 234(c) |
| Monosodium citrate | 199 | 523 | 567 | 602 | 80 | 213(d) |
| Disodium citrate sesquihydrate | 277 | 503 | 561 | 552 | 69 | 312(d) |
| Trisodium citric acid dihydrate | 238 | 286 | 450 | 486 | 63 | 240(b) |
| Disodium succinate acid | 100 | 206 | 269 | 342 | 44 | 232(b) |
| Dipotassium phthalate acid | 173 | 335 | 451 | 533 | 50 | 307(b) |

*Dog bones made from freshly prepared mix. Dog bones allowed to cool before tensile strengths were measured.
**Dog bones made from freshly prepared mix. Tensile strengths were measured 10 seconds after the dogbones were ejected and while still hot.
***Dog bones made from mixes that were held for 24 hours in a closed container. Tensile strengths were measured when the dog bones cooled.
(a) Sand mix was hard and unblowable.
(b) Sand mix was fluffy.
(c) Sand mix was fluffy/spongy.
(d) Sand mix was spongy.

Examples Describing Incorporation of the Bench Life Extender in the Hot Box Resin or Catalyst

EXAMPLE 2

Incorporation in the Resin

In this example, the additive of the invention (i.e. bench life extender) used was tripotassium citrate monohydrate. As in Example 1, 0.04% by weight based on the amount of sand (B.O.S.) of additive was used. The three-step procedure used was as follows:

(1) Making the Additive-Resin Mix

First an amount of tripotassium citrate monohydrate was dissolved in an equal weight amount of water to make a solution. Then, 2.4 grams of the solution was mixed with 51 grams of the phenolic/UF hot box resin to make the additive-resin mix and the mix was set aside.

(2) Mixing the Sand and the Catalyst

In a second step, 3000 grams of sand were placed in the Kitchen Aid Mixer, 10.2 grams of catalyst were then added to the sand and mixed for 2 minutes.

(3) Preparing the Sand Mix

In a third step, 53.4 grams of the set aside additive-resin mix were added and mixed in for three minutes.

In one set of tests, the sand mix was immediately blown at a pressure of 90 psi into a 425° F. (218° C.) dog-bone block. The dog bones were ejected from the block after 10 seconds. Tests were repeated so that dog bones were ejected after 20 seconds, 30 seconds, and 40 seconds. The tensile strength of each dog bone was measured after the dog bone had cooled. Dog bones were similarly made from a control sand mix that did not contain the tripotassium citrate monohydrate bench life extender solution.

In another set of tests, the freshly-made sand mix was placed in a closed container at ambient temperature for 24 hours after which time dog bones were blown and held for 30 seconds. It was not possible to make dog bones from the control sand mix because after 24 hours the control sand mix was hard and unblowable.

The results of the tests are reported in Table II. The results of the tests show that after being held in the closed container at room temperature for 24 hours, the control sand mix of this example was hard and unblowable, whereas the sand mix of the example was fluffy and the dog bones made with the system had acceptable tensile strength.

EXAMPLE 3

Incorporation in the Catalyst

In this example, the additive again was tripotassium citrate monohydrate. As in Example 1, 0.04% by weight of additive was used based on the amount of sand.

A three step procedure was used in this example as follows:

(1) Making the Additive-Catalyst Mix

As a first step, 1.2 grams of tripotassium citrate monohydrate were mixed with 10.2 grams of the catalyst and the mix was set aside.

(2) Mixing the Sand and the Additive-Catalyst Mix

In a second step, 3000 grams of sand were placed in the Kitchen Aid Mixer. The set-aside mix of the first step was then added to the sand and mixed in for 2 minutes.

(3) Preparing the Sand Mix

In a third step, 51 grams of the phenolic/UF hot box resin were added and mixed in for 3 minutes.

As in Example 1, in one test, some of the sand mix was immediately blown into a 425° F. (218° C.) dog bone block at 425° F. (218° C.) and the dog bone was ejected after 10 seconds. The tests were repeated so that dog bones were ejected after 20 seconds, 30 seconds and 40 seconds. The tensile strength of each dog bone was measured after it had cooled.

The test results for Example 3 are reported in Table II. The results of the tests show that in this example after 24 hours, the sand mix with the additive was still fluffy and dog bones could be made from it that had acceptable strength. The control sand mix after 24 hours was hard and unblowable.

TABLE II

TENSILE STRENGTH OF DOG BONES MADE WITH A TRIPOTASSIUM CITRATE ACID MONOHYDRATE ADDITIVE
Control Dog Bones Made Using 3000 Parts Sand, 51 Parts Resin and 1.2 Parts Catalyst (Dry Basis).

| Time, in seconds that cores are held in mold at 425° F. (218° C.) after a blowing at a pressure of 90 psi. | Tensile Strengths (psi) 10* | 20* | 30* | 40* | 30 after 24 hrs.*** |
|---|---|---|---|---|---|
| No additive (control) | 340 | 540 | 567 | 547 | — (a) |
| Example 2 | 143 | 315 | 502 | 500 | 309(b) |
| Example 3 | 170 | 389 | 569 | 541 | 336(b) |
| Additive in sand (c) | 161 | 370 | 511 | 503 | 239(b) |

*Dog bones made from freshly prepared mix. Dog bones allowed to cool before tensile strength was measured.
***Dog bones made from mixes that were held for 24 hours in a closed container. Tensile strength measured when dog bones were cooled
(a) Sand mix was hard and unblowable.
(b) Sand mix was fluffy.
(c) Procedure as described in Example 1

EXAMPLE 4

Additive, Catalyst and Resin Each Added to Sand in Separate Steps

In this example, the additive (i.e. bench life extender) used was tripotassium citrate monohydrate, and the additive was used at different levels. The procedures used were similar to those used in Example 1.

In one set of tests, this mixture was immediately blown at a pressure of 90 pounds per square inch into a 425° F. (218° C.) dog-bone block and the dog bones were ejected from the block after 10 seconds. Tests were repeated so that dog bones were ejected after 20 seconds, 30 seconds and 40 seconds. The tensile strength of each dog bone was measured after the dog bone had cooled. Dog bones were similarly made from a control sand mix without any additive.

In another set of tests, the freshly-made sand mix was placed in a closed container for 24 hours. Then the sand mix, which had been held at ambient temperature for 24 hours, was blown into the dog bone block and the dog bones were ejected after 30 seconds. The tensile strength was measured after the dog bone had cooled. It was not possible to make dog bones from a 24-hour old control sand mix (without an additive) because after 24 hours the control mix was hard and unblowable.

Four other tests were run in addition to the first test and the control test. In the other four tests 0.02%, 0.04%, 0.08% and 0.16% (B.O.S.) of additive was used, respectively. The percentages translate to the use of 0.6 grams, 1.2 grams, 2.4 grams and 4.8 grams, respectively.

The results of the five tests and the control test are shown in Table III.

The results indicate that the additive, tripotassium citrate monohydrate, is a good bench life extender if it is used in amounts at about 0.01% (B.O.S.) or higher. However, if the amount is as great as 0.16% (B.O.S.), dog bones made from the sand mix do not cure under the usual time and temperature conditions.

TABLE III

COMPARING THE TENSILE STRENGTHS OF DOG BONES MADE WITH DIFFERENT LEVELS OF ADDITIVE
Dog Bones Were Made Using 3000 Parts Sand, 51 Parts Resin, 10.2 Parts Catalyst and Different Amounts of Additive

| Time, in seconds, that cores are held in mold 425° F. (218° C.) after a blowing at a pressure of 90 psi. | Tensile Strengths (psi) 10* | 20* | 30* | 40* | 30 after 24 hrs.*** |
|---|---|---|---|---|---|
| Amount of Additive % By Weight B.O.S. | | | | | |
| 0.00 | 292 | 487 | 552 | 532 | — (a) |
| 0.01 | 369 | 510 | 548 | 571 | 135(b) |
| 0.02 | 252 | 501 | 576 | 555 | 248(b) |
| 0.04 | 178 | 315 | 489 | 498 | 302(c) |
| 0.08 | (d) | 166 | 219 | 258 | 168(c) |
| 0.16 | (d) | (d) | (d) | (d) | (c, d) |

*Dog bones made from freshly prepared mix. Dog bones allowed to cool before tensile strength was measured.
***Dog bones made from mixes that were held for 24 hours in a closed container. Tensile strength measured when dog bones were cooled.
(a) Sand mix was hard and unblowable.
(b) Sand mix was moldable but unblowable.
(c) Sand mix was fluffy.
(d) Cores were uncured.

In one test 0.01% additive (B.O.S.) was used and conducted as follows:

3000 grams of sand and 0.3 grams of additive were placed in a mixer and mixed for 1 minute. 10.2 grams of hot box catalyst were added and mixed for two minutes. 51 grams of phenolic/UF hot box resin were added and mixed for three minutes to thereby make the hot box resin and sand mixture.

EXAMPLE 5

A Heat Curable Foundry Mix Made from Two Components—a Resin Sand Mix and a Catalyst Composition In this example, a commercially useful mix of hot box resin and sand was used. Also a hot box catalyst composition was made. A suitable catalyst composition for use in the example includes a bench life extender selected from the group consisting of tripotassium citrate monohydrate; potassium phosphate, dibasic; monosodium citrate; disodium citrate sesquihydrate; trisodium citrate, dihydrate; disodium succinate, and dipotassium phthalate. In this example, the bench life extender selected was tripotassium citrate monohydrate.

Preparation of a Hot Box Catalyst Composition which Contains Bench Life Additive In this example, a hot box catalyst composition was prepared by mixing together 46.6 parts water, 32.4 parts urea, 3.8 parts ammonium chloride, 3.8 parts ammonium nitrate, 2.3 parts of a 50% silicone emulsion, 1.6 parts ammonium hydroxide solution with a specific gravity 26° Baume, and 9.5 parts tripotassium citrate monohydrate. This hot box catalyst was used at a 25% level based on binder level.

Preparation of a Control Hot Box Catalyst Composition

The control hot box catalyst composition was prepared by mixing together 37 parts water, 32.4 parts urea, 3.8 parts ammonium chloride, 3.8 parts ammonium nitrate, 2.3 parts of a 50% silicone emulsion and 1.6 parts ammonium hydroxide solution with a specific gravity 26° Baume, all parts by weight.

Making of Core Mix 3000 parts sand, 51 parts phenolic/UF hot box resin, and a suitable amount of hot box catalyst composition were placed in the Kitchen Aid mixer and mixed until well blended. The mix was then stored in a closed container for 24 hours and then used to make dogbones, if possible. When the core mix was made using the catalyst of the invention, 12.75 parts of catalyst were used in making the core mix. The control core mix was made using 10.2 parts of the control catalyst.

The tensile strengths of the dogbones were determined. The results of the tests are shown in Table IV.

The test results indicate that foundry mix which contains bench life additive remains workable if kept in a closed container for 24 hours, and cores made from 24 hour aged foundry mix have good cold tensile strength. Control foundry mix which does not contain bench life additive becomes unworkable after the same period of time.

TABLE IV

TENSILE STRENGTH TESTING OF DOG BONES PREPARED USING THE CATALYSTS DESCRIBED IN EXAMPLE 5
Dog Bones Made From Mix of 3000 Parts Sand, 12.75 Parts Catalyst Containing Bench Life Additive, 51 Parts Resin and Control Dogbones Made From Mix of 3000 Parts Sand, 51 Parts Resin, and 10.2 Parts Catalysts

| Time, in seconds of cores held in mold at 425° F. (218° C.) after blowing at a pressure of 90 psi. | 10* | 20* | 30* | 40* | 30 hot** | 30*** 24 hrs.) |
|---|---|---|---|---|---|---|
| CATALYST CONTAINING: | | | | | | |
| no additive | 254 | 511 | 539 | 524 | 73 | — (a) |
| tripotassium citrate monohydrate | 138 | 282 | 493 | 533 | 41 | 361(b) |

*Dog bones made from freshly prepared mix. Dog bones allowed to cool before tensile strengths were measured.
**Dog bones made from freshly prepared mix. Tensile strengths were measured 10 seconds after the dogbones were ejected and while still hot.
***Dog bones made from mixes that were held for 24 hours in a closed container. Tensile strengths were measured when the dog bones cooled.
(a) Sand mix was hard and unblowable.
(b) Sand mix was fluffy.

MAKING OF A SAND MIX BY MIXING FURFURYL ALCOHOL/UF HOT BOX RESIN, CATALYST, ADDITIVE (BENCH LIFE EXTENDER) AND SAND, BLOWING OF SAND MIX INTO 425° F. (218° C.) BLOCK TO MAKE DOG BONES, AND MEASURING OF TENSILE STRENGTH OF COOLED DOG BONES

EXAMPLE 6

Additive, Catalyst and Resin Each are Added to Sand in Separate Steps

In this example, the additive was tripotassium citrate, monohydrate. The catalyst used was a commercially available hot box catalyst obtained from Acme Resin Corp., Forest Park, Ill., and identified as Acme 83Q1 hot box catalyst. The hot box resin used was a commercially available furfuryl alcohol/UF hot box resin obtained from the Acme Resin Corp., Forest Park, Ill. and identified as Acme 821FW hot box resin.

3000 grams of sand and 1.2 grams of additive were placed in a mixer and mixed for 1 minute. 12.0 grams of hot box catalyst were added and mixed for two minutes. 60.0 grams of the hot box resin were added and mixed for three minutes, thereby to coat the sand to make the hot box resin and sand mix.

In one set of tests, the sand mix was immediately blown at a pressure of 90 pounds per square inch into a 425° F. (218° C.) dog-bone block. The dog bones were ejected from the block after 10 seconds. Tests were repeated so that dog bones were ejected after 20, 30, and 40 seconds. The tensile strength of each of the dog bones was measured after the dog bones had cooled. Dog bones were similarly made from a control sand mix without any additive.

In another set of tests, the freshly-made sand mix was placed in a closed container for 24 hours. Then the aged sand mix, which had been at ambient temperature for 24 hours, was blown into the heated dog bone block and the dog bones were ejected, cured, after 30 seconds. The tensile strengths were measured after the dog bones had cooled. It was not possible to make dog bones from a 24 hour old control sand mix without the additive, because the control sand mix was hard and unblowable.

The results of these tests are reported in Table V. The results of the tests show that after standing at room temperature for 24 hours, the control sand mix was hard and unblowable, whereas the sand mix containing the tripotassium citrate additive of the invention was blowable and was fluffy/spongy, and the dog bones made with this mix had reasonable tensile strengths.

These results demonstrate that the bench life extender additives of the present invention greatly reduce the tendency of the foundry mixes, containing a furan hot box resin and hot box catalyst, to become hard and unusable after being held in a closed container for 24 hours at ambient temperature.

Example 4 demonstrates that the invention is operative if the amount of additive is in the range of from about 0.01% to about 0.1% by weight based on the weight of sand. The example further demonstrates that the preferred amount of additive to use is around 0.04% by weight based on the weight of sand.

The bench life extension materials of the invention have the advantage of being soluble in the catalyst and of being low in odor. Thus, the use of these materials would not increase production steps and should be compatible with the components and equipment used to produce hot box foundry cores and molds while maintaining the desirable properties of the cured cores and molds.

While the invention has been disclosed in this patent application by reference to the details of preferred embodiments of the invention, it is to be understood that the disclosure is intended in an illustrative rather than a limiting sense, as it is contemplated that modifications may readily occur to those skilled in the art, within the spirit of the invention and the scope of the appended claims.

TABLE V

TENSILE STRENGTHS OF DOG BONES MADE WITH FURFURYL ALCOHOL/UF HOT BOX RESIN
Dog Bones Made From Mix of 3000 Parts Sand, 12.0 Parts Catalyst, 60.0 Parts Resin and 1.2 Parts Additive.
Control Dogbones Made From Mix of 3000 Parts Sand, 60.0 Parts Resin, and 12.0 Parts Catalyst.

| Time, in seconds, of cores held in mold at 425° F. (218° C.) after a blowing at a pressure of 90 psi. | 10* | 20* | 30* | 40* | 30 hot** | 30*** (24 hr) |
|---|---|---|---|---|---|---|
| Additive | | | | | | |
| none | 427 | 536 | 590 | 521 | 85 | — (a) |
| tripotassium citrate monohydrate | 87 | 321 | 444 | 504 | 58 | 248(b) |

*Dog bones made from freshly prepared mix. Dog bones allowed to cool before tensile strengths were measured.
**Dog bones made from freshly prepared mix. Tensile strengths measured 10 seconds after the dogbones were ejected and while still hot.
***Dog bones made from mixes that were held for 24 hours in a closed container. Tensile strengths measured when the dog bones cooled.
(a) Sand mix was hard and unblowable.
(b) Sand mix was fluffy/spongy.

CONCLUSIONS AND OTHER REMARKS

It has been shown by the examples that alkali metal salts of polybasic acids such as tripotassium citrate monohydrate are suitable bench-life extenders for foundry mixtures that comprise liquid thermosetting hot box resin, latent acid catalyst, and granular refractory material. The bench-life extender may be premixed into the liquid binder or it may be premixed into the catalyst. However, premixing of the extender into the liquid resin binder can lead to a diminished shelf-life of the resin. The catalyst premixes are stable mixtures and the mixing can be done well ahead of time. Therefore, on the day that a worker makes up the foundry mix, the worker need only add two components to the sand, that is, the resin and the catalyst premix. The resulting foundry mix will have a bench life of at least 24 hours.

Also, it has been shown in Example 1 not only that tripotassium citrate monohydrate can be used as a bench life extender but also that dipotassium phosphate, monosodium citrate, disodium citrate sesquihydrate, trisodium citrate dihydrate, disodium succinate and dipotassium phthalate are suitable bench life extenders and that they would be operative for use instead of tripotassium citrate monohydrate, the preferred alkali metal salt of a polybasic acid.

What is claimed is:

1. A binder composition consisting essentially of, in admixture:

(a) a thermosetting hot box binder resin;

(b) a latent acid catalyst; and (c) an amount of bench life extender sufficient to retard ambient temperature hardening of a mixture of said binder composition and sand, wherein said bench life extender comprises an alkali metal salt of a polybasic acid.

2. The binder composition of claim 1 wherein said alkali metal salt is selected from the group consisting of tripotassium citrate monohydrate; dipotassium phosphate; monosodium citrate; disodium citrate sesquihydrate; trisodium citrate dihydrate; disodium succinate, dipotassium phthalate, and mixtures thereof.

3. The binder composition of claim 2 wherein said binder resin comprises a hardenable phenolic hot box resin having a pH of at least 5, prior to addition to said composition.

4. The binder composition of claim 1 wherein said resin comprises an aqueous solution of a hot box resin selected from the group consisting of phenolic resoles, phenolic resoles blended with another resin selected from the group consisting of urea formaldehyde resin; furfuryl alcohol resin; and furfuryl alcohol modified with urea resin.

5. The binder composition of claim 1 wherein said catalyst comprises at least one mineral acid salt of ammonia.

6. The resin composition of claim 4 wherein said catalyst comprises a mineral acid salt of ammonia.

7. The resin composition of claim 2 wherein said bench life extender is soluble in at least one of said resin, said catalyst, or both.

8. A resin binder composition for use with sand and latent acid catalyst in the fabrication of foundry shapes consisting essentially of:

(a) an aqueous solution of a thermosetting hot box binder resin; and, dissolved in said solution, (b) an amount of bench life extender sufficient to retard ambient temperature hardening of a mixture of said resin composition, sand, and a latent acid catalyst composition, wherein said bench life extender comprises an alkali metal salt of polybasic acid.

9. The binder composition of claim 8 wherein said alkali metal salt is selected from the group consisting of tripotassium citrate monohydrate; dipotassium phosphate; monosodium citrate; disodium citrate sesquihydrate; trisodium citrate dihydrate; disodium succinate; dipotassium phthalate, and mixtures thereof.

10. The binder composition of claim 9 wherein said thermosetting binder resin comprises an aqueous solution of a hardenable phenolic hot box resin having a pH of at least 5.0.

11. The binder composition of claim 10 wherein said thermosetting binder composition comprises an phenolic resole resin blended with a urea formaldehyde resin.

12. A hot box resin binder component for a binder-sand mix, to impart an extended bench life, consisting essentially of an aqueous solution of a phenolic hot box resin and, dissolved therein, a bench life extender comprising an alkali metal salt of a polybasic acid.

13. The hot box resin binder component of claim 12 wherein said bench life extender comprises an alkali metal salt selected from the group consisting of tripotassium citrate monohydrate; dipotassium phosphate; monosodium citrate; disodium citrate sesquihydrate; trisodium citrate, dihydrate; disodium succinate; dipotassium phthalate; and mixtures thereof, said extender being present in an amount where, after mixing said binder with sand, the amount is from 0.01% to 0.1% by weight based on sand.

14. The resin binder of claim 13 wherein said resole solution has a pH of at least 5, is the reaction product of phenol and formaldehyde at a mole ratio in the range of from about 1:1.7 to about 1:2.7, respectively, and wherein said resole solution has a viscosity of about 250 cps to about 2000 cps.

15. The binder of claim 14 wherein said resin comprises added urea-formaldehyde resin.

16. A sand mix consisting of (a) sand or other refractory aggregate; and (b) a mix consisting essentially of a hot box binder resin and an amount of bench life extender sufficient to retard ambient temperature hardening of said sand mix, wherein said bench life extender comprises an alkali metal salt of a polybasic acid wherein the amount of said bench life extender is in the range from about 0.01% to 0.1% by weight based on sand or other refractory aggregate.

17. The sand mix of claim 16 wherein said alkali metal salt is selected from the group consisting of tripotassium citrate monohydrate; dipotassium phosphate; monosodium citrate; disodium citrate sesquihydrate; trisodium citrate dihydrate; disodium succinate; dipotassium phthalate and mixtures thereof, in an amount of 0.01% to 0.1% by weight based on said sand or other refractory aggregate.

18. The sand mix of claim 16 wherein said sand resin binder comprises an aqueous solution of a hardenable phenolic resole resin having a pH of at least 5, and wherein said latent acid catalyst comprises an aqueous solution of at least one mineral acid salt of ammonia.

19. A hot box process for making foundry cores or molds comprising (a) mixing sand, liquid thermosetting hot box binder resin, latent acid catalyst composition for said resin, and an amount of bench life extender sufficient to retard ambient temperature hardening of said mixture;

(b) blowing the product of step (a) into a heated pattern for a foundry core or mold, and permitting said resin to cure, then (c) removing the core or mold from said pattern, wherein said bench life extender comprises alkali metal salt of a polybasic acid.

20. The hot box process of claim 19 wherein said alkali metal salt is selected from the group consisting of tripotassium citrate monohydrate; dipotassium phosphate; monosodium citrate; disodium citrate sesquihydrate; trisodium citrate dihydrate; disodium succinate; dipotassium phthalate and mixtures thereof.

21. The process of claim 19 wherein said thermosetting binder resin comprises an aqueous solution of a hardenable phenolic resole resin having a pH of at least 5, blended with a urea formaldehyde resin.

22. A hot box process for making foundry shapes comprising:

(a) mixing together sand, a liquid thermosetting hot box binder resin comprising an aqueous solution of a phenolic resole resin having a pH of at least 5, a latent acid catalyst composition for said resin comprising an aqueous solution of at least one mineral acid salt of ammonia, and an amount of a bench life extender sufficient to retard ambient temperature hardening of said mixture, to form a sand mix, (b) blowing said sand mix into a heated pattern for a foundry core or mold, to cure said binder resin, and (c) removing said cured core or mold from said pattern, wherein said bench life extender comprises an alkali metal salt of a polybasic acid.

23. The process of claim 22 wherein said bench life extender is selected from the group consisting of tripotassium citrate monohydrate; dipotassium phosphate; monosodium citrate disodium citrate sesquihydrate; trisodium citrate dihydrate; disodium succinate; dipotassium phthalate, and mixtures thereof.

24. The process of claim 23 wherein said thermosetting hot box binder resin is selected from the group consisting of phenolic resole resin, phenolic resole resin modified with urea formaldehyde resin, furfuryl alcohol resin, and furfuryl alcohol resin modified with urea formaldehyde resin.

25. The process of claim 24 wherein the amount of said bench life extender is in the range from about 0.01% to 0.1% by weight based on sand.

26. The binder composition of claim 2 wherein said thermosetting hot box binder resin is selected from the group consisting of phenolic resole resin, phenolic resole resin modified with urea formaldehyde resin, furfuryl alcohol resin, and furfuryl alcohol resin modified with urea formaldehyde resin, and wherein the amount of said bench life extender is from about 0.01% to about 0.1% based on said sand, after use of said composition with sand.

27. The binder composition of claim 8 wherein said thermosetting hot box binder resin is selected from the group consisting of phenolic resole resin, phenolic resole resin modified with urea formaldehyde resin, furfuryl alcohol resin, and furfuryl alcohol resin modified with urea formaldehyde resin, and wherein the amount of said bench life extender is from about 0.01% to about 0.1% based on said sand, after use of said composition with sand.

28. The resin binder of claim 13 wherein said thermosetting hot box binder resin is selected from the group consisting of phenolic resole resin, phenolic resole resin modified with urea formaldehyde resin, furfuryl alcohol resin, and furfuryl alcohol resin modified with urea formaldehyde resin.

29. The sand mix of claim 17 wherein said thermosetting hot box binder resin is selected from the group consisting of phenolic resole resin, phenolic resole resin modified with urea formaldehyde resin, furfuryl alcohol resin, and furfuryl alcohol resin modified with urea formaldehyde resin.

30. A binder composition consisting essentially of, in admixture:

(a) a hot box binder comprising a binder of phenolic resole and urea formaldehyde resins;

(b) a latent acid catalyst; and (c) an amount of bench life extender in the range from about 0.01% to 0.1% by weight based on the weight of the sand to be used and sufficient to retard ambient temperature hardening of a mixture of said binder composition and sand for at least 24 hours, wherein said bench life extender is selected from the group consisting of tripotassium citrate monohydrate; dipotassium phosphate; monosodium citrate; disodium citrate sesquihydrate; trisodium citrate, dihydrate; disodium succinate; dipotassium phthalate, and mixtures thereof.

* * * * *

UNITED STATES PATENT AND TRADEMARK OFFICE

CERTIFICATE OF CORRECTION

PATENT NO. : 5,643,675
DATED : July 1, 1997
INVENTOR(S) : WADE, et al.

It is certified that error appears in the above-indentified patent and that said Letters Patent is hereby corrected as shown below:

In the cover page at [73] should read:

[73] Assignee: Borden Chemical, Inc., Columbus, Ohio

Signed and Sealed this

Second Day of June, 1998

*Attest:*

*Attesting Officer*

BRUCE LEHMAN

*Commissioner of Patents and Trademarks*